US010427214B2

(12) United States Patent
Sun

(10) Patent No.: US 10,427,214 B2
(45) Date of Patent: Oct. 1, 2019

(54) WATER-COOLED CENTRIFUGAL PIPE CASTING MACHINE

(71) Applicant: Shenyang Yate Industrial Machinery Making Equipment Co., Ltd., Shenyang (CN)

(72) Inventor: Xin Sun, Shenyang (CN)

(73) Assignee: Shenyang Yate Industrial Machinery Making Equipment Co., Ltd., Shenyang (CN)

( * ) Notice: Subject to any disclaimer, the term of this patent is extended or adjusted under 35 U.S.C. 154(b) by 18 days.

(21) Appl. No.: 15/862,109

(22) Filed: Jan. 4, 2018

(65) Prior Publication Data

US 2018/0257136 A1 Sep. 13, 2018

(30) Foreign Application Priority Data

Mar. 13, 2017 (CN) ..... 2017 1 0159432

(51) Int. Cl.

| | |
|---|---|
| ***B22D 41/04*** | (2006.01) |
| ***B22D 13/02*** | (2006.01) |
| ***B22D 13/10*** | (2006.01) |
| ***B22D 41/50*** | (2006.01) |

(52) U.S. Cl.

CPC ..... *B22D 41/04* (2013.01); *B22D 13/023* (2013.01); *B22D 13/105* (2013.01); *B22D 13/107* (2013.01); *B22D 13/108* (2013.01); *B22D 41/50* (2013.01)

(58) Field of Classification Search

CPC ..... B22D 41/04; B22D 41/50; B22D 13/023; B22D 13/105; B22D 13/107; B22D 13/108

See application file for complete search history.

(56) References Cited

U.S. PATENT DOCUMENTS 3,522,837 A * 8/1970 Giguere ..... B22D 13/107 164/299

* cited by examiner

*Primary Examiner* — Kevin P Kerns
*Assistant Examiner* — Steven S Ha
(74) *Attorney, Agent, or Firm* — Wood Herron & Evans LLP

(57) ABSTRACT

A water-cooled centrifugal pipe casting machine includes a sector ladle tilting system, a pouring runner, a pipe mold and a pipe removing device. The pipe mold is provided to a travel system, and rotation of the pipe mold is controlled by a pipe mold rotating system. By using a servo motor driving the sector ladle tilting system, by using a parallel four-bar linkage structure tilting a sector ladle, and by using a variable frequency motor controlling the movements of a rack and a gear of a travel driving system, a constant amount of hot metal flowing out of the sector ladle per unit time can be ensured and a constant traveling speed of the centrifugal pipe casting machine are achieved. As such, uniformity of the wall thickness of the casting pipes can be ensured, the quality thereof can be improved, and materials required can be saved.

8 Claims, 4 Drawing Sheets

WATER-COOLED CENTRIFUGAL PIPE CASTING MACHINE

CROSS-REFERENCE TO RELATED APPLICATION

This application claims priority to Chinese Application No. 201710159432.0, filed Mar. 13, 2017, which is incorporated herein by reference in its entirety.

TECHNICAL FIELD

The present invention relates to the field of metal casting, and more particularly, to a water-cooled centrifugal pipe casting machine.

BACKGROUND

The centrifugal casting method is a casting method including pouring liquid metal into a rotating mold, then the liquid metal therein fills the mold under the action of a centrifugal force and solidifies to be a cast product. This kind of machine for centrifugal casting is referred to as a centrifugal casting machine (CCM). Quality indicators of a casting pipe produced by the CCM include the uniformity of the wall thickness of the casting pipe and the weight thereof. The main factors affecting these two indicators are the tilting speed of a sector ladle of the CCM and the speed of a travel system of the CCM.

Currently, a tilting system of the sector ladle and the travel system of the water-cooled centrifugal pipe casting machine are both driven by a cylinder. During operation, due to influence of the oil temperature and the load on the cylinder, it is difficult to ensure a constant tilting speed of the sector ladle tilting system and a constant speed of the travel system, thereby affecting the rate of production of quality casting pipes and causing waste of a lot of hot metal material.

Therefore, it would be desirable to ensure the constant tilting speed of the sector ladle tilting system and the constant speed of the travel system to address an important issue faced by the person skilled in the art.

SUMMARY

The object of the present invention is to provide a water-cooled centrifugal pipe casting machine capable of solving the problems suffered by the prior art and ensuring the constant tilting speed of the sector ladle and the constant traveling speed of the pipe mold, thereby solving the problems of non-uniformity of the wall thickness of casting pipes and overweight of quality casting pipes.

To achieve the above object, the present invention provides a water-cooled centrifugal pipe casting machine including a sector ladle tilting system, a pouring runner, a pipe mold and a pipe removing device, which are connected successively. The pipe mold is provided to a travel system of the centrifugal pipe casting machine, and rotation of the pipe mold is controlled by a pipe mold rotating system. The sector ladle tilting system comprises a sector ladle, a sector ladle driving mechanism, a servo motor and a ladle tilting reducer. The servo motor is connected to the ladle tilting reducer. An output end of the ladle tilting reducer is connected to one end of the sector ladle driving mechanism, and the other end of the sector ladle driving mechanism is connected to the sector ladle.

In one aspect, the sector ladle driving mechanism includes a frame, a fixed rotation shaft, a sector ladle rotating arm, a driving rod and an active rotating arm. One end of the active rotating arm is connected to the output end of the ladle tilting reducer, and the other end thereof is connected to one end of the driving rod. The other end of the driving rod is connected to one end of the sector ladle rotating arm, and the other end of the sector ladle rotating arm is connected to the sector ladle through the fixed rotation shaft. The fixed rotation shaft is provided above the frame.

In another aspect, the length of the sector ladle rotating arm is the same as that of the active rotating arm, and the distance between the fixed rotation shaft and a shaft of the ladle tilting reducer is equal to the length of the driving rod.

In some embodiments, the travel system includes a travel trolley, a travel base and a travel driving system. The travel driving system is provided on the travel base. The travel trolley is provided on the travel driving system, and the movement of the travel trolley is controlled by the travel driving system.

In further embodiments, the travel driving system includes a trolley body connecting body, a guide rod, a guide rod mounting seat, a first rack, a rack mounting seat, a first gear, a first coupling and a power device. The guide rod is provided on the guide rod mounting seat, and the guide rod mounting seat is fixed on the travel base. The first rack is provided on the rack mounting seat, and the rack mounting seat is fixed on the travel base. The first gear is provided on the travel base. The power device is connected to an input end of the first coupling. An output end of the first coupling is connected to the first gear. The first gear is engaged with the first rack. One end of the trolley body connecting body is fixed to the travel trolley by bolts, and the other/opposite end of the trolley body connecting body is fixed to the guide rod. The guide rod is connected to the first rack.

In one aspect, the travel driving system includes a second rack, a second gear, a second coupling and a power device. The power device is connected to an input end of the second coupling, and an output end of the second coupling is connected to the second gear. The second gear is engaged with the second rack. The second rack is connected to the trolley body of the second travel trolley. The second gear is provided on the travel base.

In a further aspect, the power device comprises a motor and a drive reducer. An output end of the motor is connected to an input end of the drive reducer, and an output end of the drive reducer is connected to an input end of the first coupling or the second coupling.

Preferably, the motor is a variable frequency motor.

Compared to the prior art, the present invention generates the following technical advantages: by using the servo motor driving the sector ladle tilting system and by using a parallel four-bar linkage structure tilting the sector ladle, control for the constant tilting speed of the sector ladle can be easily achieved, and the constant amount of hot metal flowing out of the sector ladle per unit time can be further controlled. In addition, by using the variable frequency motor controlling the movements of the rack and the gear of the travel driving system, a constant traveling speed of the centrifugal pipe casting machine can be achieved. By providing the configuration described above, traveling stability and reliability of the transfer speed of the centrifugal pipe casting machine can be ensured, thereby ensuring uniformity of the wall thickness of the casting pipes, improving the quality thereof and saving materials required.

BRIEF DESCRIPTION OF THE DRAWINGS

Various additional features and advantages of the invention will become more apparent to those of ordinary skill in the art upon review of the following detailed description of one or more illustrative embodiments taken in conjunction with the accompanying drawings. The accompanying drawings, which are incorporated in and constitute a part of this specification, illustrate one or more embodiments of the invention and, together with the general description given above and the detailed description given below, explain the one or more embodiments of the invention.

DETAILED DESCRIPTION

In order to make the above object, features and advantages of the present invention more clear and obvious, the present invention will be described in detail with reference to the appended drawings and embodiments hereinafter. The embodiments of the present invention will be described below in a clear and complete manner in conjunction with the appended drawings. It should be appreciated that the described embodiments are only a part of the embodiments encompassed by the present invention. All other embodiments obtained by those skilled in the art based on the embodiments disclosed herein without further creative efforts shall fall within the protection scope of the present invention.

Embodiment I

Figure 1:
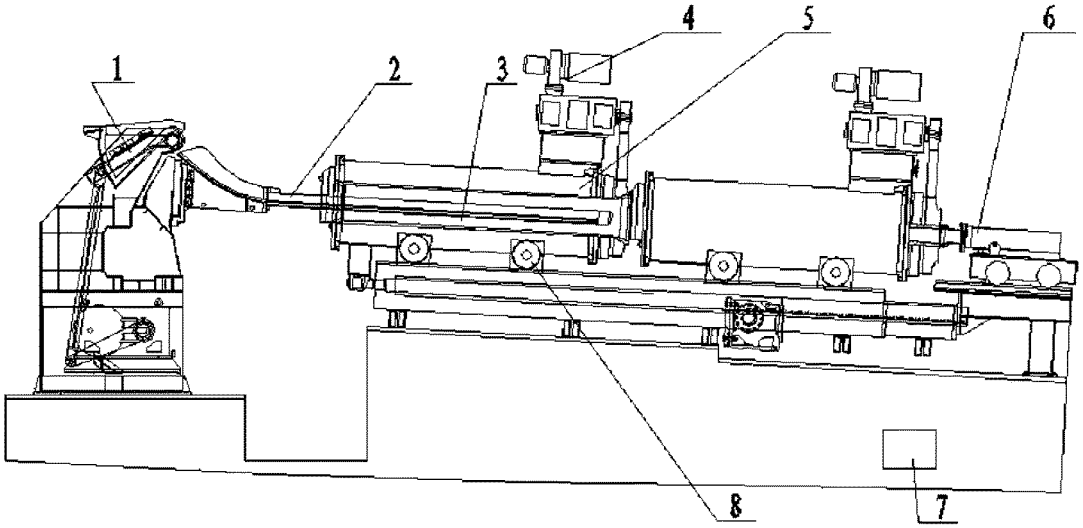
FIG. 1 is a front view of a water-cooled centrifugal pipe casting machine according to one embodiment of the invention.

As shown in FIG. 1, the present invention provides a water-cooled centrifugal pipe casting machine, comprising a sector ladle tilting system 1, a pouring runner 2, a pipe mold 3 and a pipe removing device 6, which are connected successively. The pipe mold 3 is associated with a travel system 8 of the centrifugal pipe casting machine. Hot metal enters the pipe mold 3 from the sector ladle tilting system 1 through the pouring runner 2. A pipe mold rotating system 4 rotates the pipe mold 3, and the travel system 8 moves the pipe mold 3 simultaneously, thereby causing the hot metal to distribute on an inner surface of the pipe mold 3 because of the application of centrifugal force. The hot metal inside the pipe mold 3 is cooled into a casting pipe by cooling water 5 provided to an outer surface of the pipe mold. The casting pipe is then removed from the pipe mold 3 by the pipe removing device 6. A control system 7 is included in the centrifugal pipe casting machine for performing a logical control for each working procedure.

Figure 2:
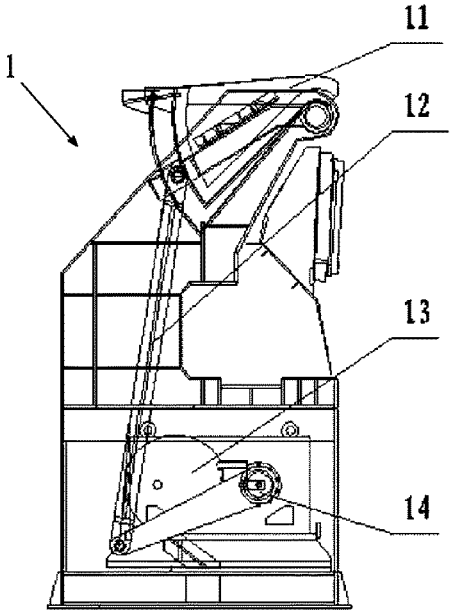
FIG. 2 is a front view of a sector ladle tilting system of the pipe casting machine of FIG. 1.
Figure 3:
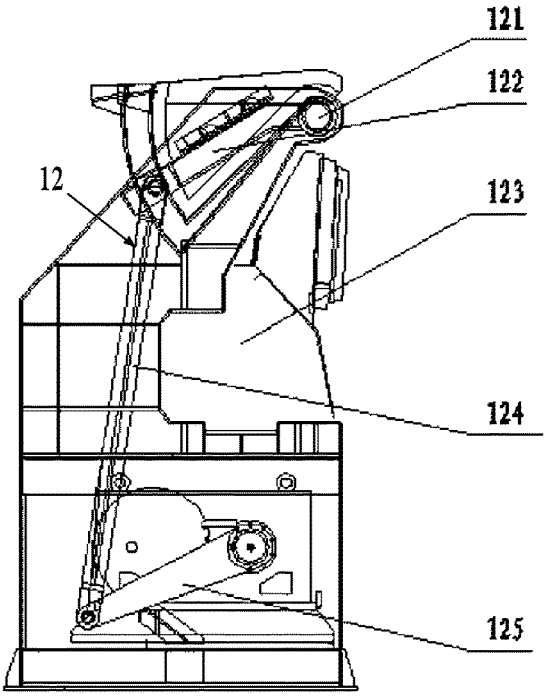
FIG. 3 is a front view of a sector ladle driving mechanism of the pipe casting machine of FIG. 1.

As shown in FIGS. 2 and 3, the sector ladle tilting system 1 of this embodiment of the present invention comprises a sector ladle 11, a sector ladle driving mechanism 12, a servo motor 13 and a ladle tilting reducer 14. The servo motor 13 is connected to the ladle tilting reducer 14. An output end of the ladle tilting reducer 14 is connected to one end of the sector ladle driving mechanism 12, and the other/opposite end of the sector ladle driving mechanism 12 is connected to the sector ladle 11.

With reference to FIG. 3, the sector ladle driving mechanism 12 comprises a frame 123, a fixed rotation shaft 121, a sector ladle rotating arm 122, a driving rod 124 and an active rotating arm 125. One end of the active rotating arm 125 is connected to the output end of the ladle tilting reducer 14, and the other/opposite end thereof is connected to one end of the driving rod 124. The other/opposite end of the driving rod 124 is connected to one end of the sector ladle rotating arm 122, and the other/opposite end of the sector ladle rotating arm 122 is connected to the sector ladle through the fixed rotation shaft 121. The fixed rotation shaft 121 is provided above the frame 123.

The operating process of the sector ladle driving mechanism 12 of this embodiment of the present invention is as follows: the servo motor 13 rotates the active rotating arm 125 through the ladle tilting reducer 14, the active rotating arm 125 then moves the driving rod 124, the driving rod 124 further moves the sector ladle rotating arm 122, and the sector ladle is then rotated by the rotating sector ladle rotating arm 122.

The sector ladle rotating arm 122 has the same length as the active rotating arm 125. The distance between the fixed rotation shaft 121 and a shaft of the ladle tilting reducer 14 is equal to the length of the driving rod 124, which makes the sector ladle rotating arm 122, the driving rod 124, the active rotating arm 125 and the frame 123 form a parallel four-bar linkage structure. Accordingly, resulting from the parallel four-bar linkage structure of the sector ladle driving mechanism 12, the rotating speed of the active rotating arm 125 is the same as that of the sector ladle rotating arm 122. To this end, the rotating speeds of the ladle tilting reducer 14 and the sector ladle are the same. Thus, the rotating speed of the sector ladle can be controlled by controlling the servo motor 13 through a servo driving system. If the speed of the servo motor 13 is constant in unit time, the rotating speed of the sector ladle can be controlled to be constant, and the amount of hot metal flowing out of the sector ladle per unit time can be further controlled to be constant.

In the production of DN300 pipes by the water-cooled centrifugal pipe casting machine of this invention, the ladle tilting time of the sector ladle is 20-30 seconds, and the return time thereof is 3-5 seconds. The ladle tilting angle is about 45-72 degrees. The ladle tilting speed of the sector ladle is 1.5-3.6 degrees/second, and the return speed thereof is 9-24 degrees/second. The rotating speed of the sector ladle is adjusted by a controller of the servo motor 13.

Figure 4:
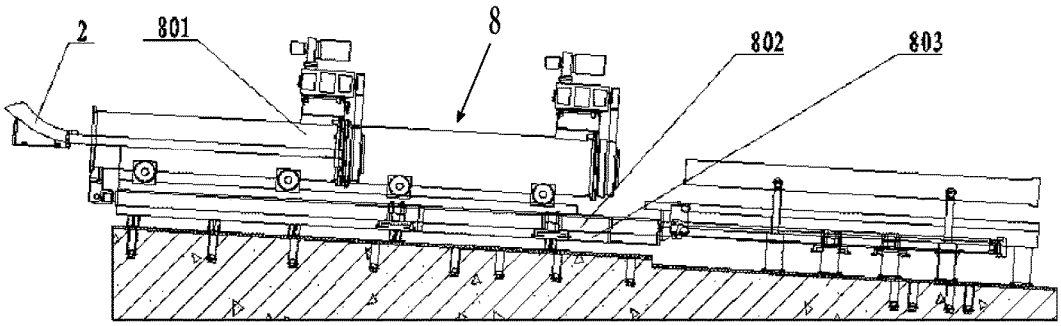
FIG. 4 is a front view of one embodiment of a travel system that may be included in the water-cooled centrifugal pipe casting machine of FIG. 1.

As shown in FIG. 4, the travel system 8 of the centrifugal pipe casting machine comprises a first travel trolley 801, a first travel base 803 and a first travel driving system 802. The first travel driving system 802 is provided on the first travel base 803. The first travel trolley 801 is provided on the first travel driving system 802. The movement of the first travel trolley 801 is controlled by the first travel driving system 802. Under the action of the first travel driving system 802, four wheels of the first travel trolley 801 can travel on rails defined by the first travel base 803.

Figure 5:
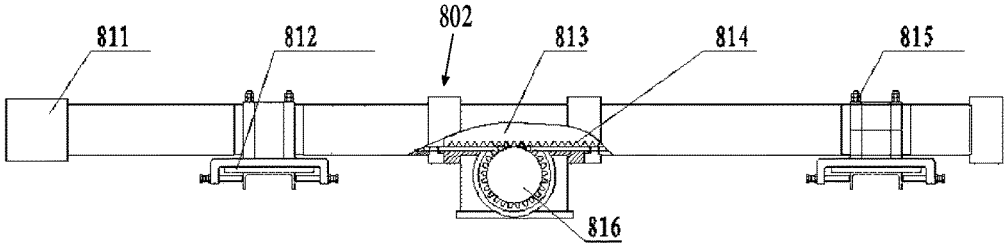
FIG. 5 is a front view of one embodiment of a travel driving system that may be included in the water-cooled centrifugal pipe casting machine of FIG. 1, with a partial portion cross-sectioned to reveal internal aspects thereof.
Figure 6:
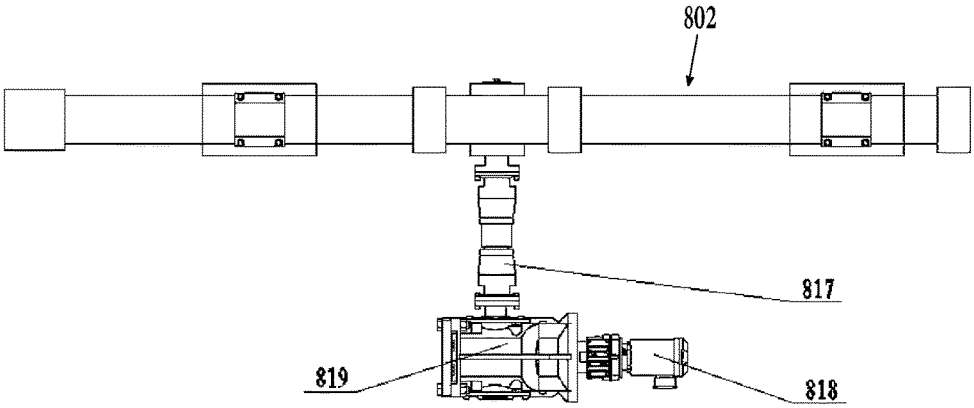
FIG. 6 is a side view of the travel driving system of FIG. 5, showing further aspects thereof.

As shown in FIGS. 5 and 6, the first travel driving system 802 comprises a trolley body connecting body 811, a guide rod 813, a guide rod mounting seat 812, a first rack 814, a rack mounting seat 815, a first gear 816, a first coupling 817, a variable frequency motor 818 and a driving reducer 819. The guide rod 813 is provided on the guide rod mounting seat 812. The guide rod mounting seat 812 is fixed on the first travel base 803. The first rack 814 is provided on the rack mounting seat 815. The rack mounting seat 815 is fixed on the first travel base 803. The first gear 816 is provided on the first travel base 803. An output end of the variable frequency motor 818 is connected to an input end of the driving reducer 819, and the output end of driving reducer 819 is connected to an input end of the first coupling 817. An output end of the first coupling 817 is connected to the first gear 816. The first gear 816 is engaged with the first rack 814. One end of the trolley body connecting body 811 is fixed to the first travel trolley 801 by bolts, and the other/opposite end is fixed to the guide rod 813. The guide rod 813 is connected to the first rack 814.

The operating process of the first travel driving system 802 of the centrifugal pipe casting machine is as follows: the variable frequency motor 818 and the driving reducer 819 rotate the first gear 816 via the first coupling 817, and the first gear 816 then drives the first rack 814 to move forward and backward; when the first rack 814 moves, the guide rod 813 drives the first travel trolley 801 to travel on the rails of the first travel base 803.

Embodiment II

This embodiment is substantially equivalent to the first embodiment described above and shown in FIGS. 4 through 6, except that the structure of the travel system is different.

Figure 7:
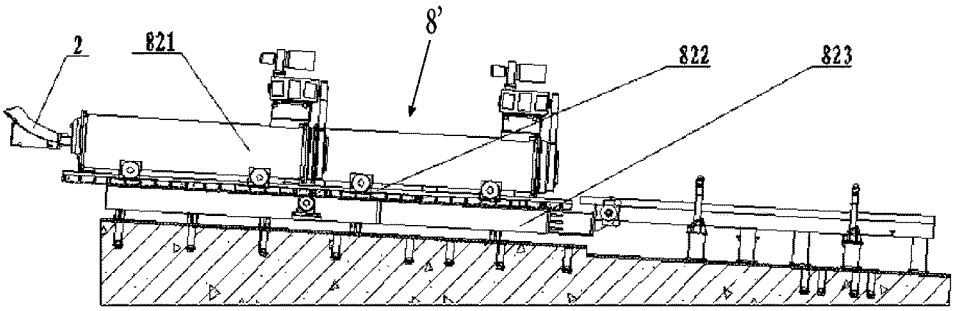
FIG. 7 is a front view of another embodiment of a travel system that may be included in the water-cooled centrifugal pipe casting machine of FIG. 1.

As shown in FIG. 7, another embodiment of the travel system 8' of the water-cooled centrifugal pipe casting machine may be provided. In this embodiment, the travel system 8' comprises a second travel trolley 821, a second travel base 823, and a second travel driving system 822. The second travel driving system 822 is provided on the second travel base 823. The second travel trolley 821 is provided on the second travel driving system 822. The second travel driving system 822 controls the movement of the second travel trolley 821. Under the action of the second travel driving system 822, four wheels of the second travel trolley 821 travel on the rails of the second travel base 823.

Figure 8:
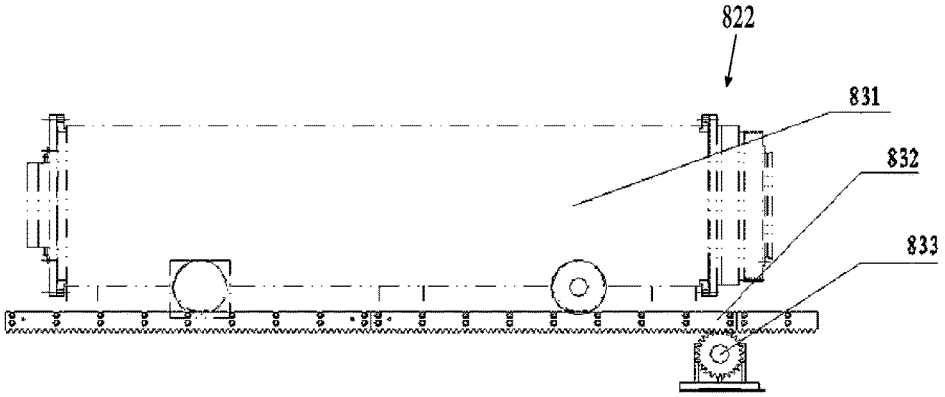
FIG. 8 is a front view of another embodiment of a travel driving system that may be included in the water-cooled centrifugal pipe casting machine of FIG. 1.
Figure 9:
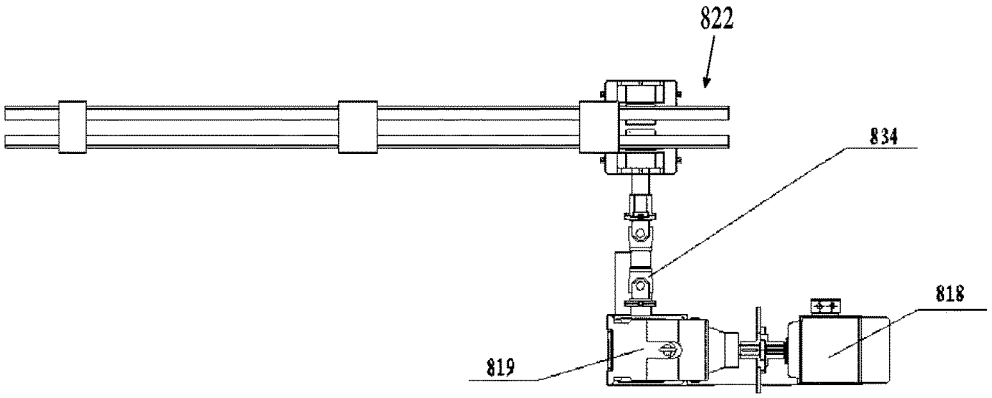
FIG. 9 is a side view of the travel driving system of FIG. 8, showing further aspects thereof.

As shown in FIGS. 8 and 9, the second travel driving system 822 comprises a second rack 832, a second gear 833, a second coupling 834, a variable frequency motor 818 and a driving reducer 819. An output end of the variable frequency motor 818 is connected to an input end of the driving reducer 819, and an output end of the driving reducer 819 is connected to an input end of the second coupling 834. An output end of the second coupling 834 is connected to the second gear 833. The second gear 833 is engaged with the second rack 832. The second rack 832 is connected to the trolley body 831 of the second travel trolley 821. The second gear 833 is provided on the second travel base 823.

The operating process of the second travel driving system 822 is as follows: the variable frequency motor 818 and the driving reducer 819 rotate the second gear 833 via the second coupling 834, and the second gear 833 drives the second rack 832 to move forward and backward; the second rack 832 is fixed to the trolley body 831 of the second travel trolley 821, and the second travel trolley 821 thus can move forward and backward.

During the production of DN300 pipes by the water-cooled centrifugal pipe casting machine of this invention, pouring travel time of the centrifugal pipe casting machine is 13-18 seconds, and pipe removing travel time is 6-8 seconds. A stroke of the centrifugal pipe casting machine is about 6200 mm. The pouring speed of the centrifugal pipe casting machine is 344-477 mm/second, and the pipe removing travel speed is 775-1033 mm/second. The traveling speed of the centrifugal pipe casting machine is adjusted by a frequency converter.

Each embodiment of the invention is described in a progressive manner and focusing on the differences from the others, and reference can be made to the description of the other embodiments for the same or similar parts.

Although the principle and implementations of the present invention have been described above by specific examples in the present invention, the foregoing description of the embodiments is merely for helping understanding the method and core idea of the present invention. Meanwhile, various alterations to the specific implementations and applications may come to a person of ordinary skill in the art according to the concept of the present invention. In conclusion, the contents of the description shall not be regarded as limitations to the present invention.

REFERENCE LIST

1: Sector ladle tilting system
2: Pouring runner
3: Pipe mold
4: Pipe mold rotating system
5: Cooling water
6: Pipe removing device
7: Control system
8: Travel system
11: Sector ladle
12: Sector ladle driving mechanism,
13: Servo motor
14: Ladle tilting reducer
121: Fixed rotation shaft
122: Sector ladle rotating arm
123: Frame
124: Driving rod
125: Active rotating arm
801: First travel trolley
802: First driving system
803: First travel base
811: Trolley body connecting body
812: Mounting seat for a guide rod
813: Guide rod
814: First rack
815: Mounting seat for a rack
816: First gear
817: First coupling
818: Variable frequency motor
819: Driving reducer
821: Second travel trolley
822: Second travel driving system
823: Second travel base
831: Second travel trolley body
832: Second rack
833: Second gear
834: Second coupling

What is claimed is:

1. A water-cooled centrifugal pipe casting machine, comprising:

a sector ladle tilting system, a pouring runner,
a pipe mold, and
a pipe removing device, each of which are connected successively,
wherein the pipe mold is provided to a travel system, and rotation of the pipe mold is controlled by a pipe mold rotating system,
the sector ladle tilting system comprises a sector ladle, a sector ladle driving mechanism, a servo motor, and a ladle tilting reducer,
wherein the servo motor is connected to the ladle tilting reducer, an output end of the ladle tilting reducer is connected to one end of the sector ladle driving mechanism, and an opposite end of the sector ladle driving mechanism is connected to the sector ladle,
wherein the sector ladle driving mechanism comprises:
a frame,
a fixed rotation shaft,
a sector ladle rotating arm,
a driving rod, and
an active rotating arm,
wherein one end of the active rotating arm is connected to the output end of the ladle tilting reducer, an opposite end of the active rotating arm is connected to one end of the driving rod, an opposite end of the driving rod is connected to one end of the sector ladle rotating arm, an opposite end of the sector ladle rotating arm is connected to the sector ladle through the fixed rotation shaft, and the fixed rotation shaft is provided above the frame, and
wherein a length of the sector ladle rotating arm is the same as a length of the active rotating arm, and a distance between the fixed rotation shaft and a shaft of the ladle tilting reducer is equal to a length of the driving rod.

2. The water-cooled centrifugal pipe casting machine of claim 1, wherein the travel system comprises:
a travel trolley,
a travel base, and
a travel driving system,
wherein, the travel driving system is provided on the travel base, the travel trolley is provided on the travel driving system, and movement of the travel trolley is controlled by the travel driving system.

3. A water-cooled centrifugal pipe casting machine, comprising:
a sector ladle tilting system,
a pouring runner,
a pipe mold, and
a pipe removing device, each of which are connected successively,
wherein the pipe mold is provided to a travel system, and rotation of the pipe mold is controlled by a pipe mold rotating system,
the sector ladle tilting system comprises a sector ladle, a sector ladle driving mechanism, a servo motor, and a ladle tilting reducer,
wherein the servo motor is connected to the ladle tilting reducer, an output end of the ladle tilting reducer is connected to one end of the sector ladle driving mechanism, and an opposite end of the sector ladle driving mechanism is connected to the sector ladle,
wherein the travel system comprises:
a travel trolley,
a travel base, and
a travel driving system,
wherein the travel driving system is provided on the travel base, the travel trolley is provided on the travel driving system, and movement of the travel trolley is controlled by the travel driving system,
wherein the travel driving system comprises:
a trolley body connecting body,
a guide rod,
a guide rod mounting seat,
a rack,
a rack mounting seat,
a gear,
a coupling, and
a power device,
wherein the guide rod is provided on the guide rod mounting seat, the guide rod mounting seat is fixed on the travel base, the rack is provided on the rack mounting seat, the rack mounting seat is fixed on the travel base, the gear is provided on the travel base, the power device is connected to an input end of the coupling, an output end of the coupling is connected to the gear, the gear is engaged with the rack, one end of the trolley body connecting body is fixed to the travel trolley by bolts, an opposite end of the trolley body connecting body is fixed to the guide rod, and the guide rod is connected to the rack.

4. The water-cooled centrifugal pipe casting machine of claim 3, wherein the power device comprises a motor and a drive reducer, an output end of the motor is connected to an input end of the drive reducer, and an output end of the drive reducer is connected to an input end of the coupling.

5. The water-cooled centrifugal pipe casting machine of claim 4, wherein the motor is a variable frequency motor.

6. A water-cooled centrifugal pipe casting machine, comprising:
a sector ladle tilting system,
a pouring runner,
a pipe mold, and
a pipe removing device, each of which are connected successively,
wherein the pipe mold is provided to a travel system, and rotation of the pipe mold is controlled by a pipe mold rotating system,
the sector ladle tilting system comprises a sector ladle, a sector ladle driving mechanism, a servo motor, and a ladle tilting reducer,
wherein the servo motor is connected to the ladle tilting reducer, an output end of the ladle tilting reducer is connected to one end of the sector ladle driving mechanism, and an opposite end of the sector ladle driving mechanism is connected to the sector ladle,
wherein the travel system comprises:
a travel trolley,
a travel base, and
a travel driving system,
wherein the travel driving system is provided on the travel base, the travel trolley is provided on the travel driving system, and movement of the travel trolley is controlled by the travel driving system,
wherein the travel driving system comprises:
a rack,
a gear,
a coupling, and
a power device,
wherein the power device is connected to an input end of the coupling, an output end of the coupling is connected to the gear, the gear is engaged with the rack, the rack is connected to a trolley body of the travel trolley, and the gear is provided on the travel base.

7. The water-cooled centrifugal pipe casting machine of claim 6, wherein the power device comprises a motor and a drive reducer, an output end of the motor is connected to an input end of the drive reducer, and an output end of the drive reducer is connected to an input end of the coupling.

8. The water-cooled centrifugal pipe casting machine of claim 7, wherein the motor is a variable frequency motor.

* * * * *